US006273755B1

(12) United States Patent
Yamamoto

(10) Patent No.: US 6,273,755 B1
(45) Date of Patent: Aug. 14, 2001

(54) CONNECTOR

(75) Inventor: Hiroshi Yamamoto, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/575,646

(22) Filed: May 31, 2000

(30) Foreign Application Priority Data

Jun. 18, 1999 (JP) ..... 11-173010

(51) Int. Cl.[7] ..... H01R 30/40
(52) U.S. Cl. ..... 439/596
(58) Field of Search ..... 439/596, 752, 439/468, 469

(56) References Cited

U.S. PATENT DOCUMENTS 3,920,306 * 11/1975 Barnett, Jr. et al. ..... 339/103 M
4,226,494 * 10/1980 Mazzeo et al. ..... 339/103 R
4,702,712 * 10/1987 Ghorbani et al. ..... 439/596
5,759,065 * 6/1998 Hatagishi et al. ..... 439/596
6,027,374 * 2/2000 Nagai et al. ..... 439/596

FOREIGN PATENT DOCUMENTS

Sho 63-54283 4/1988 (JP) .

* cited by examiner

*Primary Examiner*—Gary Paumen
*Assistant Examiner*—P Nguyen
(74) *Attorney, Agent, or Firm*—Finnegan, Henderson, Farabow, Garrett & Dunner, L.L.P.

(57) ABSTRACT

A connector has first and second housings, a cover, and a projection. A terminal is accommodated within the first housing. The second housing has an electric-wire accommodation chamber for accommodating an electric wire that is connected to the terminal and an opening for being used with respect to the electric-wire accommodation chamber. The second housing is provided integrally with the first housing. The cover is openably or closably connected to the second housing via a hinge and closes the opening of the second housing. The projection protrudes from the inner surface of the cover into the electric-wire accommodation chamber of the second housing and prevents the electric wire from getting out of regular position.

4 Claims, 6 Drawing Sheets

CONNECTOR

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Description of Related Art

A connector that is disclosed in Japanese Utility Model Application Laid-Open No. 63-54283 has a terminal accommodation housing for accommodating a terminal therein, an electric-wire accommodation housing integrated with the terminal accommodation housing, and a cover for covering a rear-surface opening of the electric-wire accommodation housing.

The terminal accommodation housing is shaped like a character T. And this housing has a central space portion for preventing the occurrence of deformation due to warpage, palpus, etc. at the time of injection molding and a plurality of mutually independent terminal accommodation portions located around the central space portion. Each terminal accommodation portion has a terminal insertion opening that a mating terminal (male terminal) is inserted into.

The electric-wire accommodation housing that has an opening and that is shaped like a rectangular block has an electric-wire accommodation chamber for accommodating therein an electric wire that has been connected to its corresponding terminal, and an engaging/retaining projection for having attached thereto a cover for covering the opening and protecting the electric-wire accommodation chamber.

The cover is openably or closably connected to the electric-wire accommodation housing via a hinge. An engaging/retaining frame portion equipped with an engaging hole portion that is engaged with the engaging/retaining projection of the electric-wire accommodation housing is formed on the cover in such a way as to oppose this projection. The engaging/retaining projection of the electric-wire accommodation housing being engaged with the engaging hole portion of the engaging/retaining frame portion, the cover is mounted on the electric-wire accommodation housing in a state of its closing the opening.

According to the above-described connector, shutting the cover and closing the opening, the direction in which each electric wire accommodated within the electric-wire accommodation chamber is taken out is regulated, with the result that the respective electric wires are prevented from getting intertwined with one another.

2. Technical Field of the Invention

The present invention relates to a connector.

SUMMARY OF THE INVENTION

However, in the above-constructed connector, when the electric wire has been pulled away with some irresistible force or another, e.g., when the connector is fitted to a mating connector, the following possibilities come up. Namely, it is possible that the electric wire will be moved into between the electric-wire accommodation housing and the cover and that this will cause damages to the electric wire. Further, it is also possible that the engagement of the engaging/retaining projection and the engaging/retaining frame portion will get released and that as a result the cover will be made open.

An object of the present invention is to provide a connector that prevents the electric wire from being moved into between the housing and the cover without making the configuration of the housing complex and that therefore reliably keeps the electric wire intact and prevents the cover from getting disengaged from the housing.

To attain the above object, a first aspect of connector according to the present invention has first and second housings, a cover, and a projection. A terminal is accommodated within the first housing. The second housing has an electric-wire accommodation chamber for accommodating an electric wire connected to the terminal, and an opening for being used with respect to the electric-wire accommodation chamber. The second housing is provided integrally with the first housing. The cover is connected to the second housing via a hinge so that the cover may be freely opened or closed with respect thereto. And the cover closes the opening of the second housing. The projection protrudes from an inner surface of the cover into the interior of the electric-wire accommodation chamber of the second housing to thereby prevent the electric wire within the second housing from being positionally displaced.

According to this construction, even when the electric wire within the electric-wire accommodation chamber has been pulled with some irresistible force or another, the electric wire comes into contact with the projection, whereby the positional displacement of the electric wire is prevented. Accordingly, it is possible to prevent the positional displacement of the electric wire with a simple construction without making up the housing into a complex configuration.

In a second aspect of connector according to the present invention, when the electric wire has been pulled toward the opening, the projection comes into contact with an inner wall of the electric-wire accommodation chamber.

According to this construction, when the electric wire has been pulled toward the opening, the projection abuts on an inner wall surface of the electric-wire accommodation chamber to thereby prevent the cover from getting open. Therefore, it is possible to prevent the electric wire from being moved into between the second housing and the cover. Accordingly, the electric wire and the cover are reliably prevented from being damaged and getting disengaged from the opening, respectively.

In a third aspect of connector according to the present invention, the second housing has a plurality of mutually independent electric-wire accommodation chambers. The projection protrudes into the electric-wire accommodation chamber that adjoins to an open end of the second housing opposing a hinge.

In a fourth aspect of connector according to the present invention, the second housing has a plurality of mutually independent electric-wire accommodation chambers. The cover has a plurality of projections that protrude into the electric-wire accommodation chambers, respectively.

DESCRIPTION OF THE PREFERRED EMBODIMENTS

A concrete embodiment to which the present invention is applied will now be explained with reference to the drawings.

A connector according to this embodiment is the one that is arranged to prevent an electric wire from being drawn in between a housing and a cover without making up the configuration of the housing into a complex one. By doing so, the connector is arranged to enable protecting the electric wire as well as preventing the cover from getting unlocked from the housing.

Figure 1:
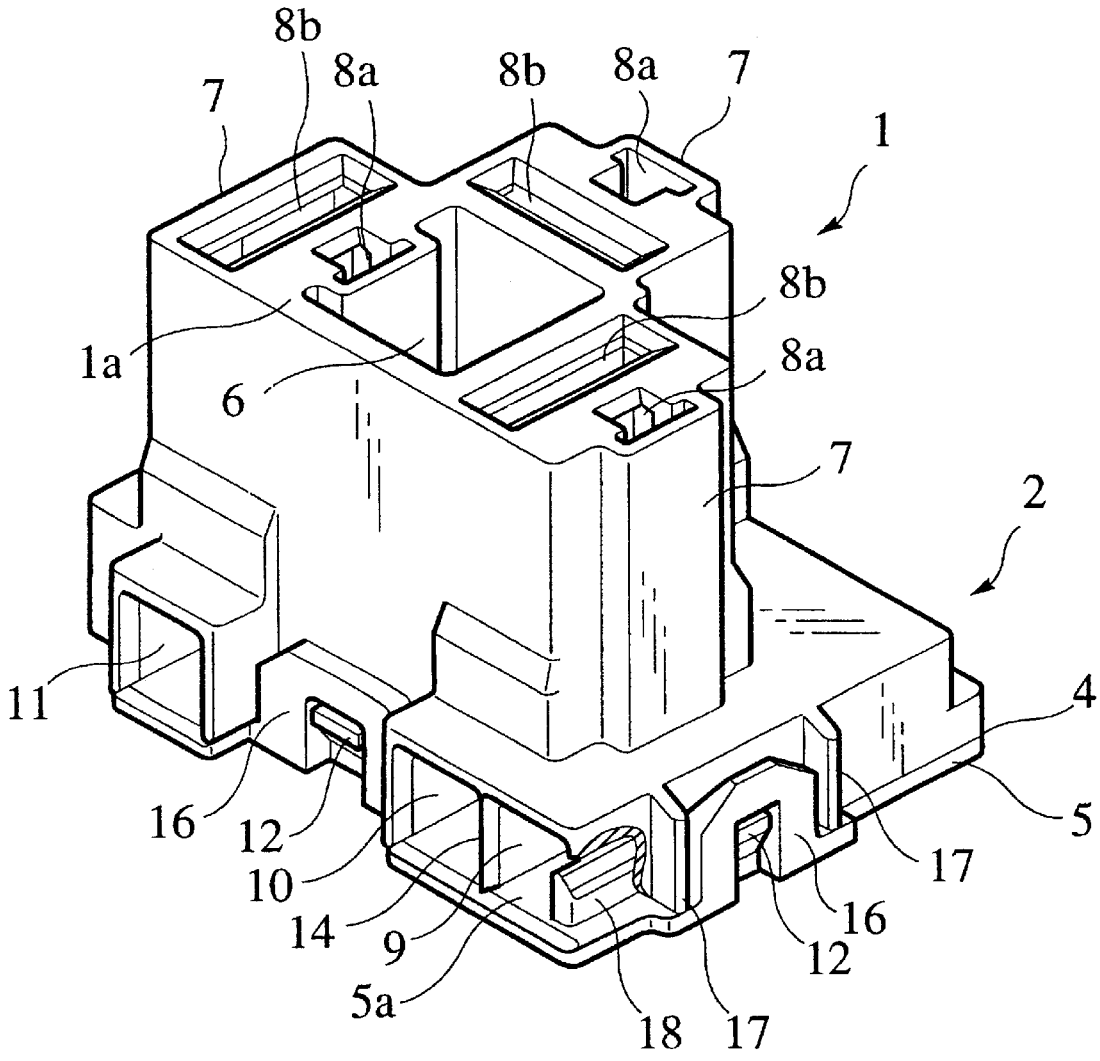
FIG. 1 is a perspective view illustrating a connector according to an embodiment of the present invention.
Figure 2:
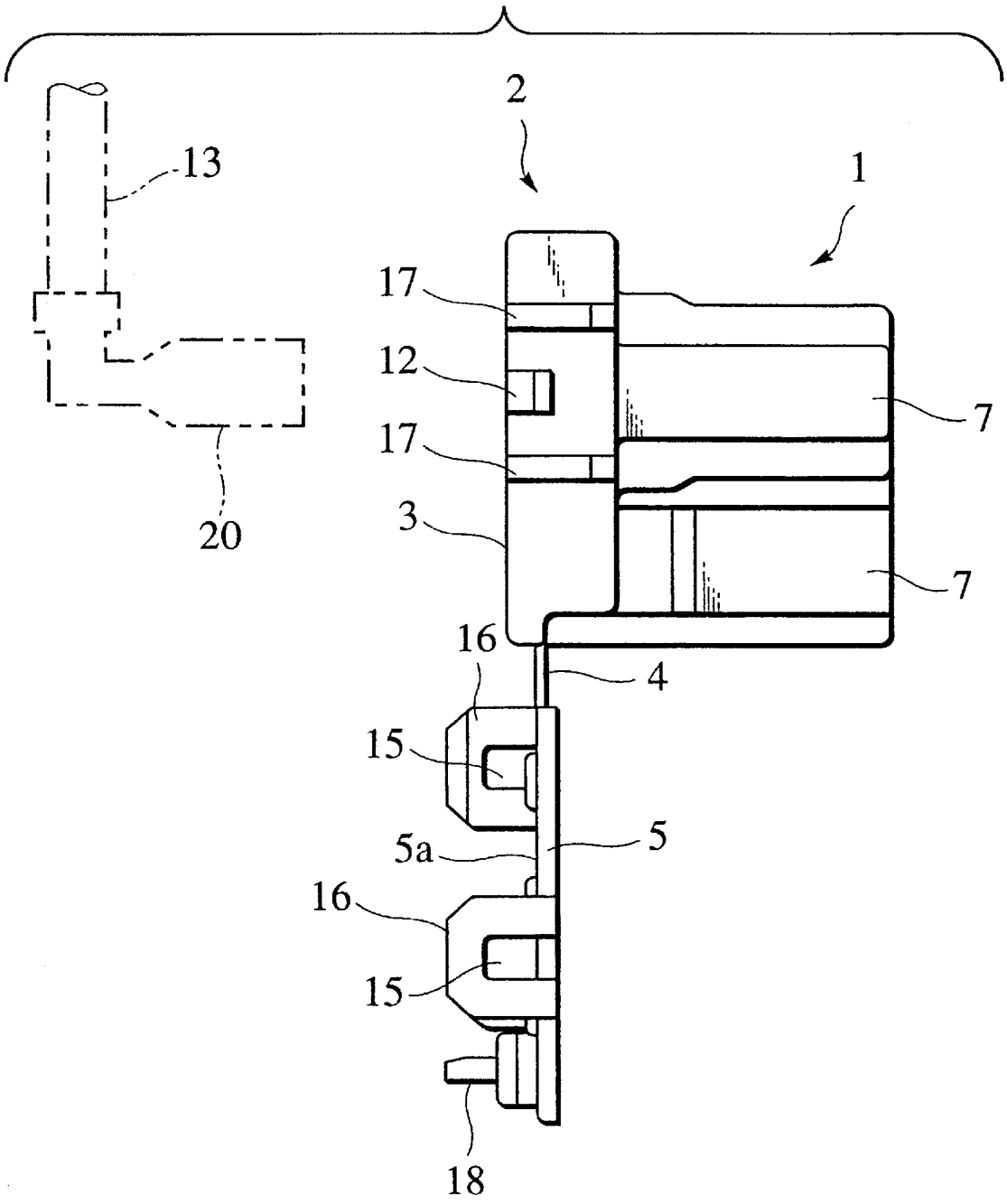
FIG. 2 is a side view illustrating the connector, the cover of that has been opened.

As illustrated in FIGS. 1 and 2, the connector is composed of the following three members. A first one is a terminal accommodation housing (first housing) 1 for accommodating a terminal 20 therein. A second one is an electric-wire accommodation housing (second housing) 2 that is integrated with this terminal accommodation housing (first housing) 2 and that is intended to accommodate therein an electric wire 13 connected to the terminal 20. And a third one is a cover 5 that closes a rear-surface opening 3 of the housing 2 and that is openably or closably provided on the housing 2 via a hinge 4.

As illustrated in FIG. 1, the housing 1 is formed as a T-shaped block that is made of insulating resin material. The housing 1 has a central space portion 6 for preventing the deformation such as warpage and palpus at the time of injection molding, and also has terminal accommodation portions 7, 7, and 7 that are located around the central space portion 6. The housing 1 also has terminal insertion openings 8*b* that are disposed in a fitting front surface 1*a* thereof to that a mating connector is fitted, and through that mating terminals are inserted, respectively.

In the terminal accommodation portions 7, 7, and 7 there are formed terminal accommodation chambers (not illustrated) into that the terminals (female terminals) 20 are accommodated. These terminals 20 are fitted into and accommodated within the terminal accommodation chambers from the rear-surface opening 3 of the housing 2.

As illustrated in FIG. 1, the terminal insertion openings 8*b* are formed in the fitting front surface 1*a* corresponding to the respective terminal accommodation chambers, and the terminal insertion openings 8*b* are communicated with the terminal accommodation chambers, respectively. Each terminal insertion opening 8*b* has a configuration conforming to the outer configuration of a mating terminal that is fitted into and mounted on its corresponding terminal accommodated within its corresponding terminal accommodation chamber. Therefore, the terminal insertion opening 8*b* has, for example, a laterally elongate, rectangular configuration.

It is to be noted that in the vicinity of each terminal insertion opening 8*b* formed in its corresponding terminal accommodation portion 7 there is formed a lance-forming space portion 8*a* for forming a lance portion.

As illustrated in FIGS. 1 and 2, the housing 2 has electric-wire accommodation chambers 9, 10, and 11 for accommodating therein the electric wires 13 that have been connected to their corresponding terminals 20, and the housing 2 is integrated with the housing 1. The housing 2 is formed as a rectangular block having a rear-surface opening 3, the rear surface of that is made open. The housing 2 has on its side wall surfaces and its upper end surface engaging/retaining projections 12 for locking the cover 5 as later described that closes the rear-surface opening 3 and protects the respective electric-wire accommodation chambers 9, 10, and 11.

It is to be noted that in FIG. 1 the engaging/retaining projections 12, 12 formed on one of the side wall surfaces and on the upper end surface are only illustrated and the illustration is omitted of the engaging/retaining projection 12 formed on the other side wall surface.

The electric-wire accommodation chambers 9, 10, and 11 respectively have space portions that are large enough to accommodate therein the electric wires 13 connected to the terminals 20, and these chambers are respectively independently formed. The rear-surface opening 3 being closed by the cover 5, the direction in which the electric wires 13 are taken out is regulated. In this embodiment, the electric-wire accommodation chambers 9, 10, and 11 are formed three in number. One electric-wire accommodation chamber 11 is disposed being spaced away from the remaining two electric-wire accommodation chambers 9 and 10. The two electric-wire accommodation chambers 9 and 10 are disposed adjacently to each other with a partitioning wall 14 existing in between.

As illustrated in FIGS. 1 and 2, the cover 5 is used to cover the rear-surface opening 3 of the housing 2 to thereby protect the electric-wire accommodation chambers 9, 10, and 11. The cover 5 is freely openably or closably connected to the housing 2 via the hinge 4. The cover 5 has locking/engaging/retaining frame portions 16 that have formed therein engaging hole portions 15 that are engaged with the engaging/retaining projections 12 of the housing 2. These locking/engaging/retaining frame portions 16 are formed at the positions that oppose the engaging/retaining projections 12, respectively.

The engaging/retaining projections 12 of the housing 2 being engaged with the engaging hole portions 15 of the locking/engaging/retaining frame portions 16, the cover 5 is locked to the housing 2. Each of the locking/engaging/retaining frame portions 16 that have been engaged with the engaging/retaining projections 12 formed on the both side walls of the housing 2 is fitted in between a pair of guide portions 17 and 17 that are projectingly formed on the housing 2. In contrast to this, the locking/engaging/retaining frame portions 16 that has been engaged with the engaging/retaining projections 12 formed on the upper end surface of the housing 2 is fitted in between the walls of the housing constituting the projecting left/right electric-wire accommodation chambers 9, 10, and 11.

Figure 3:
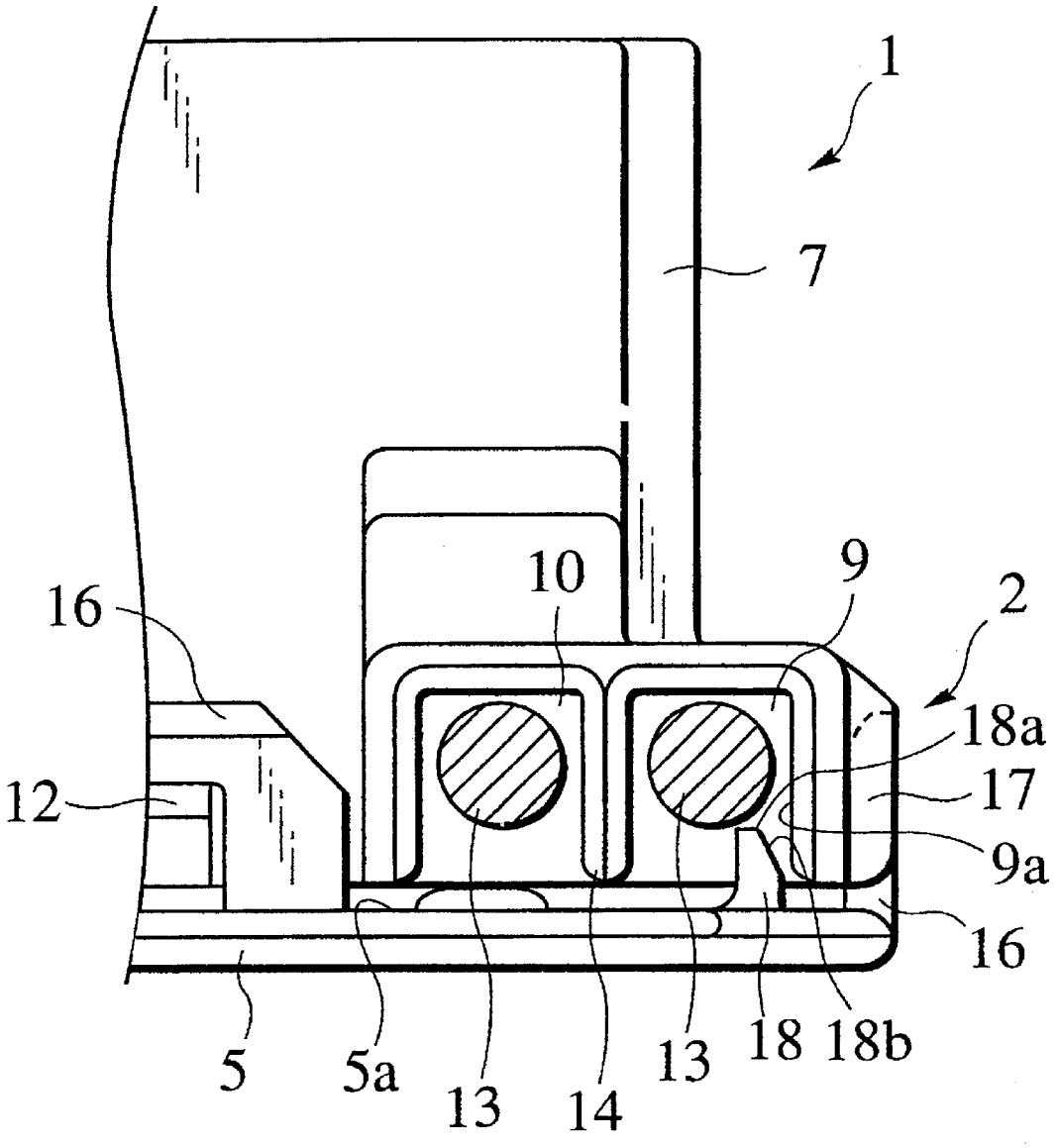
FIG. 3 is an enlarged plan view illustrating a main part of electric-wire accommodation chambers.
Figure 4:
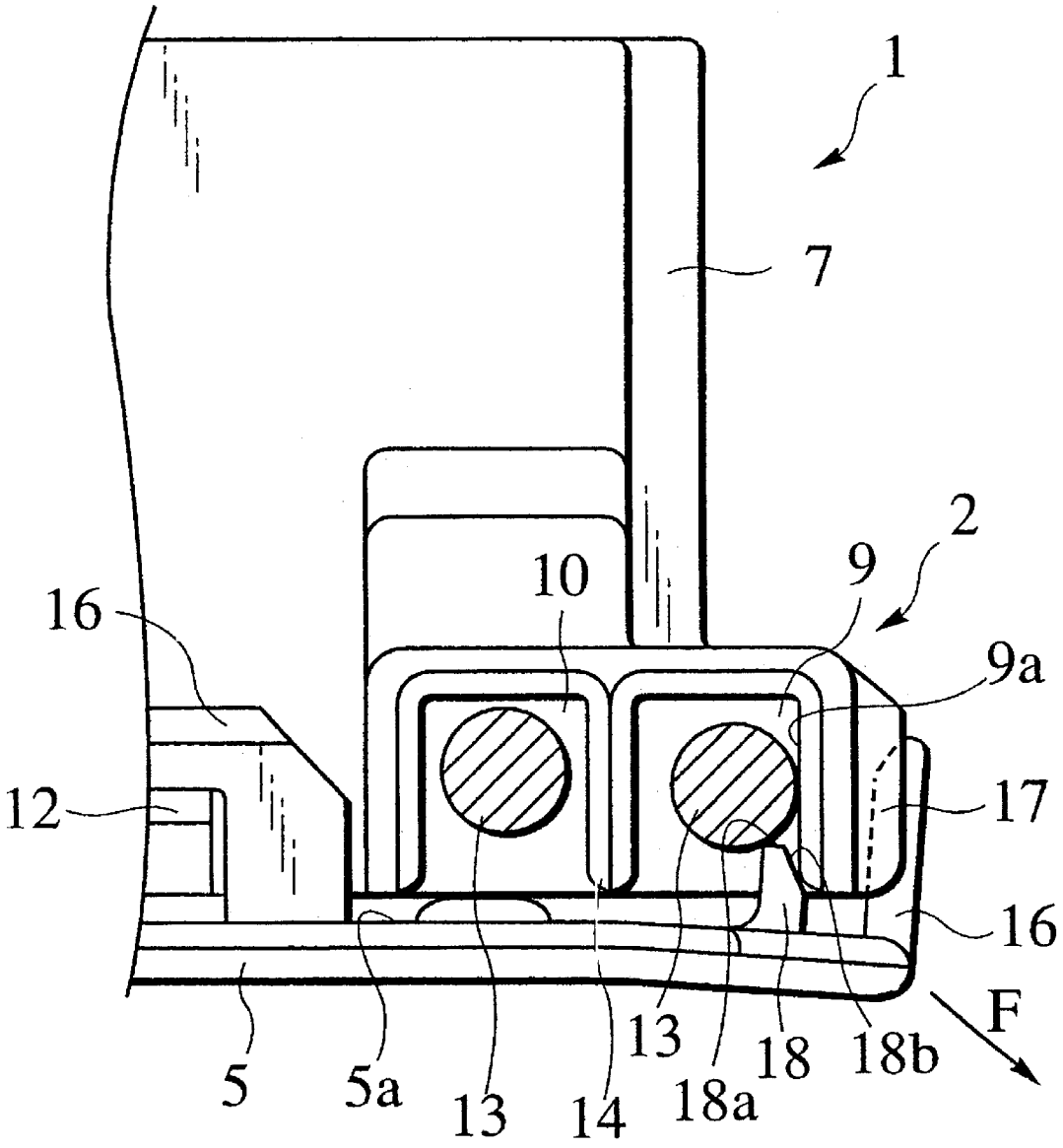
FIG. 4 is an enlarged plan view illustrating a main part of a state where a projection has abutted on an inner wall of the electric-wire accommodation chamber.

Especially, in this embodiment, as illustrated in FIGS. 1 to 3, on an inner surface 5*a* of the cover 5 there is provided an electric-wire position displacement prevention projection 18 that protrudes into its corresponding electric wire accommodation chamber 9 of the electric-wire accommodation housing 2. As illustrated in FIG. 4, for example, when at the time of fitting to a mating connector the electric wire 13 has been pulled to an open-end side of the electric-wire accommodation chamber 9 with some irresistible force or another, the projection 18 abuts on the inner wall surface 9*a* of the electric-wire accommodation chamber 9.

Namely, as illustrated in FIGS. 1 and 3, the projection 18 is formed vertically elongate and receives the electric wire 13 by its forward end portion 18*a*. The projection 18 has formed thereon an inclined-surface-like receiver surface 18*b* that abuts on an inner wall surface 9*a* of the electric-wire accommodation chamber 9.

Next, an electric-wire-13-fitting-in preventing mechanism of the connector that has been constructed as mentioned above will be explained.

As illustrated in FIG. 3, the terminal 20 (illustrated in FIG. 2) is accommodated into its corresponding terminal accommodation portion 7, 7, or 7. Simultaneously, the electric wire 13 that has been connected to its corresponding terminal 20 is accommodated into its corresponding electric-wire accommodation chamber 9, 10, or 11. Then, the cover 5 is mounted over the electric-wire accommodation housing 2 and locked thereto. From this condition, for example, as illustrated in FIG. 4, when at the time of fitting to a mating connector the electric wire 13 has been pulled to the open-end side of the electric-wire accommodation chamber 9 (in the direction indicated by an arrow F in which the electric wire 13 is clamped or pinched by and between the electric-wire accommodation housing 2 and the cover 5) with some irresistible force or another, the following function occurs.

When the electric wire 13 is pulled from a normal state of accommodation of FIG. 3 in the arrow-F-indicated direction of FIG. 4, the electric wire 13 comes into contact with the forward end portion 18*a* of the projection 18 protruding into the electric-wire accommodation chamber 9. As a result of this, the projection 18 is pushed in the arrow-F-indicated direction by the electric wire 13. As a result of this, a side edge portion of the cover 5 is separated from the housing 2, whereby a small size of space (a space into that the electric wire 13 cannot be fitted) is formed between the housing 2 and the cover 5.

Upon increase of this space, the receiver surface 18*b* of the projection 18 abuts on the inner wall surface 9*a* of the electric-wire accommodation chamber 9, whereby the opening movement of the cover 5 is stopped. Since of course the engaging/retaining projections 12 and the locking/engaging/retaining frame portions 16 are engaged with each other, the cover 5 is opened no further. Accordingly, the electric wire 13 is reliably prevented from getting inconveniently fitted in between the housing 2 and the cover 5 without making the configuration of the housing complex. The opening of the cover 5 is thereby reliably prevented.

In the above-described way, in the connector of this embodiment, on the inner surface 5*a* of the cover 5 there is provided the projection 18 that protrudes into its corresponding electric-wire accommodation chamber 9. For this reason, even when the electric wire 13 within the electric-wire accommodation chamber 9 is pulled with some irresistible force or another, the electric wire 13 comes into contact with the projection 18. And, as a result of this, the position displacement of the electric wire 13 has been pulled to the open-end side of the electric-wire accommodation chamber 9, the projection 18 abuts on the inner wall surface 9*a* of the electric-wire accommodation chamber 9. Therefore, the cover 5 is prevented from getting opened and so the electric wire 13 is prevented from getting pinched in between the housing 2 and the cover 5.

Although the concrete embodiment having had this invention applied thereto has above been explained, the invention is not limited to the above embodiment and permits various changes and modifications to be made.

Figure 5:
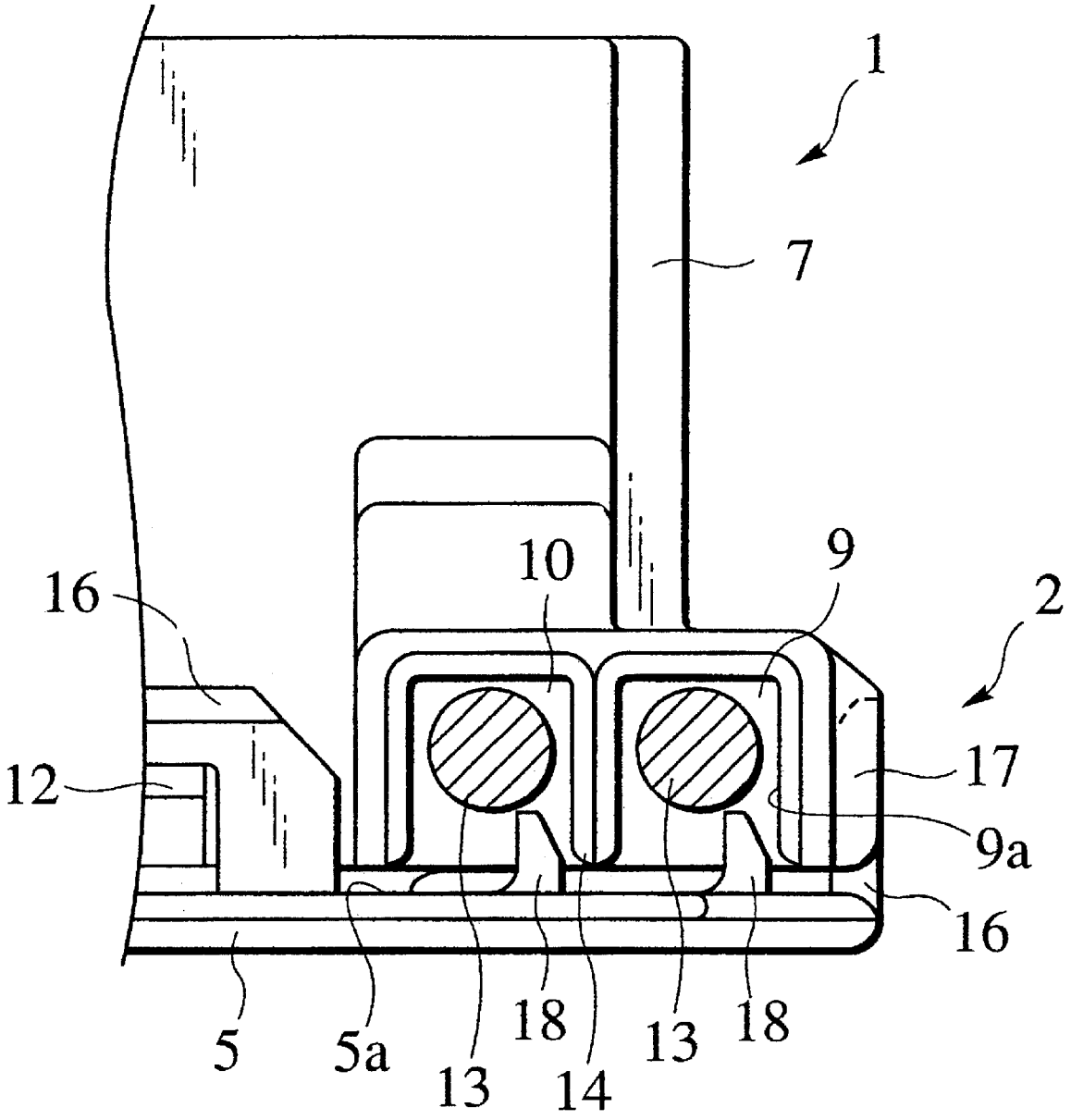
FIG. 5 is an enlarged plan view of a main part of the electric-wire accommodation chambers, illustrating an example wherein the projection has been provided in correspondence with its corresponding electric-wire accommodation chamber.

In the above-described embodiment, among a plurality of the electric-wire accommodation chambers 9, 10, and 11, the projection 18 has been provided so as to protrude into the outer-side electric-wire accommodation chamber 9. However, as illustrated in FIG. 5, the projection 18 may be provided on the cover 5 so as to protrude into every one of the electric-wire accommodation chambers 9, 10, and 11. When doing so, whichever direction the electric wire 13 is pulled in, the cover 5 is prevented from getting opened more largely than in a prescribed amount (an amount that can permit the electric wire 13 to be pinched between the electric-wire accommodation housing 2 and the cover 5).

Figure 6:
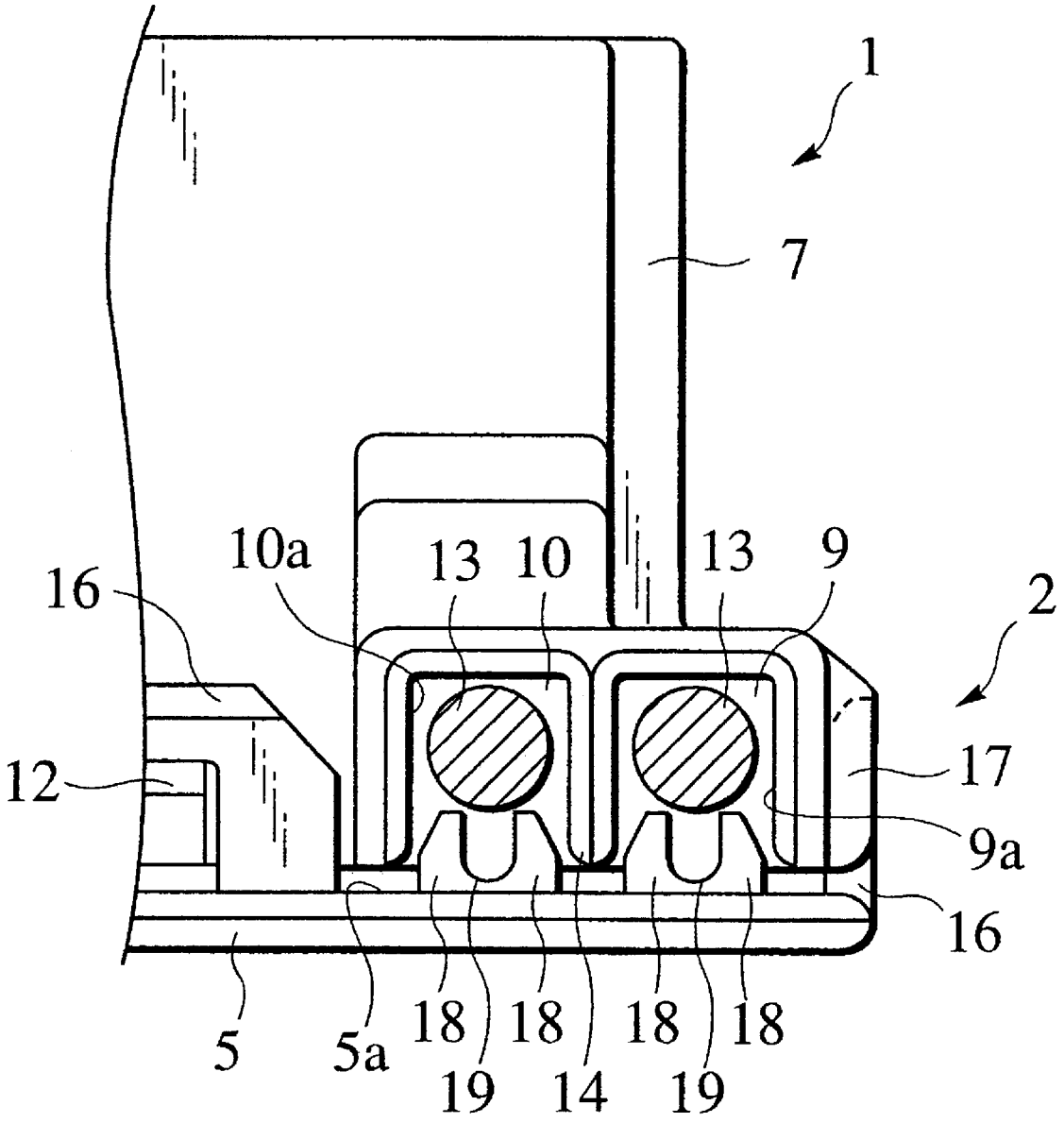
FIG. 6 is an enlarged plan view of a main part of the electric-wire accommodation chamber portion and its neighboring area, illustrating an example wherein the two projections have been provided in correspondence with their corresponding electric-wire accommodation chamber.

Also, it may be arranged that the projection 18 be provided two in number in each of the electric-wire accommodation chambers 9, 10, and 11 and each of these projections be provided at the above-described position. In addition, as illustrated in FIG. 6, it may be arranged that each two paired projections 18 and 18 be connected to each other by means of a circular-arc-like portion 19, whereby the electric wire 13 is fitted into this circular-arc-like-portion 19. If doing so, whichever direction the electric wire 13 is pulled in, the electric wire 13 is fitted into the circular-arc-like portion 19. Of course, even in this case, the projection 18 abuts on the inner wall surface 9*a* or 10*a* of the electric-wire accommodation chambers 9, 10, and 11 to thereby enable preventing the electric wire 13 from getting into between the electric-wire accommodation housing 2 and the cover 5.

Deposit of Computer Program Listings

Not Applicable

What is claimed is:

1. A connector comprising:

a first housing for accommodating a terminal therein;

a second housing having an electric-wire accommodation chamber for accommodating an electric wire that is connected to the terminal and an opening for being used with respect to the electric-wire accommodation chamber, the second housing being provided integrally with the first housing;

a cover for covering the opening of the second housing, the cover being openably or closably connected to the second housing via a hinge; and a projection for preventing a positional displacement of the electric wire within the second housing, the projection protruding from an inner surface of the cover into the electric-wire accommodation chamber of the second housing, wherein when the electric wire is pulled toward the opening, the projection comes in contact with an inner wall of the electric-wire accommodation chamber.

2. A connector according to claim 1, wherein the second housing has a plurality of mutually independent electric-wire accommodation chambers, and the projection protrudes into the electric-wire accommodation chamber that adjoins to an open end of the second housing that opposes the hinge.

3. A connector according to claim 1, wherein the second housing has a plurality of mutually independent electric-wire accommodation chambers, and the cover has a plurality of projections that protrude into their corresponding electric-wire accommodation chambers.

4. A connector according to claim 1, wherein the opening opposes the first housing.

* * * * *